United States Patent [19]

Plonsky et al.

[11] Patent Number: 5,049,857

[45] Date of Patent: Sep. 17, 1991

[54] MULTI-MODE ELECTRONIC ARTICLE SURVEILLANCE SYSTEM

[75] Inventors: Christopher B. Plonsky, Boynton Beach; Harry E. Watkins, Boca Raton; Marco A. Paez, Wellington, all of Fla.

[73] Assignee: Sensormatic Electronics Corporation, Deerfield Beach, Fla.

[21] Appl. No.: 384,556

[22] Filed: Jul. 24, 1989

[51] Int. Cl.[5] ..... G08B 13/24

[52] U.S. Cl. ..... 340/551; 340/572; 455/78

[58] Field of Search ..... 340/551, 572, 522, 516, 340/825.7–825.72, 505, 825.54; 455/78

[56] References Cited

U.S. PATENT DOCUMENTS

| | | | |
|---|---|---|---|
| 3,859,624 | 1/1975 | Kriofsky et al. | 340/572 X |
| 4,779,076 | 10/1988 | Weaver | 340/551 |
| 4,791,412 | 12/1988 | Brooks | 340/572 |
| 4,797,659 | 1/1989 | Larsen | 340/572 |

*Primary Examiner*—Glen R. Swann, III
*Assistant Examiner*—Thomas J. Mullen, Jr.
*Attorney, Agent, or Firm*—Robin, Blecker, Daley & Driscoll

[57] ABSTRACT

A magnetic article surveillance system in which surveillance is carried out by operating the system in first and second different modes of a magnetic transmitting and receiver means in order to make a determination as to the presence of an article in the zone.

62 Claims, 8 Drawing Sheets

MULTI-MODE ELECTRONIC ARTICLE SURVEILLANCE SYSTEM

BACKGROUND OF THE INVENTION

This invention relates to electronic article surveillance systems and, in particular, to electronic article surveillance systems in which magnetic radiation or energy is used to carry out the article surveillance.

Electronic article surveillance systems are known in the art wherein surveillance is carried out by transmitting a magnetic field into an interrogation zone. In these systems, determining the presence of the articles under surveillance is accomplished by sensing perturbations to the transmitted magnetic field. These perturbations are generated by tags attached to or incorporated into the articles. These tags carry or are formed from magnetic markers or materials which create the perturbations.

In designing article surveillance systems of this type, attention is focused on achieving certain characteristics or criteria which are of importance to the user. One characteristic is referred to as the system "width." This characteristic defines the maximum width of the interrogation zone which can be used, while still detecting articles carrying valid tags with reliability. It is desirable that the system width be maximized so as to give the widest possible interrogation zone. This makes the surveillance system adaptable to a greater number of user locations.

A second characteristic is referred to as the system "pick." This is a measure of the percentage of time that the system identifies articles bearing valid tags. It is important that this characteristic also be maximized in order for the system to operate credibly as a surveillance system.

A third characteristic is the system "false alarm" rate. This characteristic is a measure of the percentage of time the surveillance system alarms as a result of objects other than articles carrying valid tags. Frequently, false alarms are brought about by metal objects such as shopping carts or watches passing through the interrogation zone. It is essential that the false alarm rate of the surveillance system be minimized to likewise promote system credibility as well as to avoid embarrassment to the user of having the system alarm for objects other than those under surveillance.

Other characteristics of the surveillance system of interest to the user involve the ability of the system to operate properly with tags which are deactivatable and with fixed metal objects in the floors, walls and other equipment in or bordering the interrogation zone. In the case of deactivatable tags, it is desired that the system alarm only for articles carrying tags which are in their active state. In the case of fixed metal objects, it is desired that the system be substantially immune to the otherwise masking effects of these objects.

The magnetic article surveillance systems designed to date have had difficulty in achieving all these characteristics. These systems generally fall into two categories. In one category of system, the antenna or coil used to transmit the magnetic field into the interrogation zone (the "transmitter coil") and the antenna or coil which receives magnetic energy from the zone (the "receiver coil") are disposed in spaced housings or pedestals which border the interrogation zone. This category of system is referred to as a "transmit/receive" system. Because of the spacing between the transmitter and receiver coils of the transmit/receive system (usually this spacing defines the system width), there is a relatively low coupling of magnetic energy therebetween.

In using the transmit/receive system, it has been found that acceptable pick rates are achievable and that low false alarm rates are also achievable, but only for objects with low masses such as, for example, deactivated tags and watches. This low false alarm rate for low mass objects is due to the aforementioned low coupling between the transmitter and receiver coils. Such low coupling causes the receiver coil sensitivity to be relatively low in areas where the transmitted energy is high. Hence, received energy due to low mass objects is usually insufficient to meet the criteria established for determining the presence of articles carrying valid tags. However, even with this low sensitivity of the receiver coil, high mass objects are found to generate sufficient received energy to meet these criteria, thereby causing false alarms.

A second category of system used for magnetic article surveillance is referred to as a "transceiver" system. In this type of system, transmitter and receiver coils are housed in common pedestals at each of a number of locations bordering the interrogation zone. Because of this common housing of the transmitter and receiver coils in close proximity to each other, there is a high coupling of magnetic energy therebetween.

In using the transceiver system, it has been found that the system provides a good pick rate for articles carrying single tags. It has also been found that the system provides a relatively low false alarm rate, but only for high mass objects such as, for example, shopping carts. This low false alarm rate for high mass objects occurs because of the high coupling between the transmitter and receiver coils. This coupling causes the receiver coil to be highly sensitive in the same areas where the transmitter energy is high. As a result, in the presence of high mass metal objects, the received energy becomes sufficient to meet the criteria established for identifying metal objects, before the criteria for identifying articles carrying valid tags are met. The high mass objects can thus be detected before the system alarms.

The transceiver system, however, provides a relatively higher false alarm rate for low mass objects, e.g., deactivated tags, watches, etc. Low mass objects are found to result in sufficient received energy to meet the criteria for identifying articles carrying valid tags, before the criteria for metal objects are met. Hence, the system is likely to false alarm for these low mass objects.

The transmit/receive and the transceiver systems can be modified in certain conventional ways to attempt to enhance their operation. Thus, to decrease false alarms and sensitivity to fixed metal objects, the transmitted energy can be decreased by decreasing the current to the transmitter coil. Decreasing the transmitted energy, however, decreases the system width and/or pick rate. Also, the criteria for differentiating between received signals indicative of articles carrying valid tags and those indicative of other metal objects can be varied or changed to provide some limited improvement in the pick and false alarm rates. Finally, placing more than one tag in an article can be used to increase the pick rate.

The above techniques for enhancing system operation have thus provided only limited improvement in system performance. Hence, there is still a need for a system which can provide a relatively wide system width, a relatively high pick rate and a relatively low false alarm rate for objects of low and high masses.

It is therefore an object of the present invention to provide an electronic article surveillance system having enhanced performance.

It is a further object of the present invention to provide an enhanced electronic article surveillance system which utilizes magnetic energy and tags employing magnetic markers.

It is a further object of the present invention to provide a magnetic electronic article surveillance system in which the system false alarm rate can be relatively low for objects of different masses.

It is yet a further object of the present invention to provide a magnetic electronic article surveillance system in which the system false alarm rate can be relatively low for objects of high and low masses and in which the system width and pick rate can be relatively high.

SUMMARY OF THE INVENTION

In accordance with the principles of the present invention, the above and other objectives are realized in an article surveillance system which is provided with a first means for transmitting magnetic energy into an interrogation zone and for receiving magnetic energy including energy from the zone. The first means has at least first and second modes of operation and a second means responsive to the first means is provided to control the first means such that it operates in at least the first and second modes of operation in order to make a determination as to the presence of an article bearing a tag. By using the two modes of operation of the first means before the system can make a determination of article presence, the system is able to have a high pick rate, a high system width and a low false alarm rate.

The first and second modes of operation of the first means can be made different by utilizing different energy transmitting and/or energy receiving characteristics in each mode. These differences in characteristic can be realized by changing the transmitting field amplitude or frequency or by using a multiple of transmitted frequencies. These effects, in turn, can be brought about, in part, by using one or more transmitters in the first means and selectively activating the transmitter antennae. The differences in characteristic can also be brought about by changing with one or more of the latter changes or alone, the sensitivity of the first means to the magnetic energy. This sensitivity change can be realized by using one or more receivers and changing the receiver sensitivity by selectively activating the receiver antennae or modifying the gain of the receiver electronics.

In the embodiment of the invention to be disclosed hereinafter, the first means includes a first transmitter for transmitting magnetic energy into the interrogation zone and first and second receivers which are adapted to receive magnetic energy including energy from the zone. The first and second receivers are coupled to the transmitter such that the coupling of magnetic energy between the first transmitter and the first receiver is greater than the coupling of magnetic energy between the first transmitter and the second receiver. The second means selectively operates the transmitter and receivers to achieve the first and second modes. In the first mode, the first transmitter and second receiver are in their on or active states, while the first receiver is in its off or inactive state. In the second mode, the first transmitter and first and second receivers are in their on or active states.

In this embodiment, the system also preferably comprises a second transmitter whose coupling to the receivers is such that the coupling of magnetic energy between the second transmitter and the second receiver is greater than that between the second transmitter and the first receiver. The second means controls the second transmitter such that it is in its off or inactive state during the first mode of operation and such that it is in its on or active state during the second mode of operation.

With the system configured as above, the system is operated by the second means in its first mode of operation, which is a transmit/receive mode, and the system makes a first determination in accordance with a first set of criteria as to the presence in the interrogation zone of an article bearing a valid tag. If these criteria are met, the second means then switches the system to the second mode of operation, which is a transceiver mode, and the second means makes a second determination in accordance with a second set of criteria as to the presence of the article. If these second criteria are also met, the system alarms indicating the presence of the article in the interrogation zone.

In the embodiments of the invention to be disclosed hereinafter, the first set of criteria are based upon the level of one or more frequency components in the received magnetic energy. These frequency components are those at predetermined harmonics of the fundamental frequency of the magnetic energy transmitted into the interrogation zone. The second criteria, in turn, are dependent upon the level and/or phase of the received energy component at the fundamental frequency in relationship to the level and/or phase of the transmitted energy at such frequency.

Also, in these embodiments, the second means controls the transmitters such that during the first or transmit/receive mode the first transmitter transmits a field of lower level than that transmitted by each of first and second transmitters during the second or transceiver mode. Further, the second means provides predetermined delays at preselected times in order to ensure proper operation and stabilization of the system components. The system is additionally provided with an initialization and recalibration procedure which allows the system to calibrate and recalibrate ambient conditions and adjust criteria thresholds during operation.

In a first embodiment of the invention to be disclosed hereinafter, a single relay contact switch is used to jointly control the second transmitter and second receiver and to switch the components between their respective on and off states. In a second embodiment, circuitry is provided which allows independent control of the on and off states of each of the transmitters and receivers.

BRIEF DESCRIPTION OF THE DRAWING

The above and other features and aspects of the present invention will become more apparent upon reading the following detailed description in conjunction with accompanying drawings, in which.

DETAILED DESCRIPTION

Figure 1:
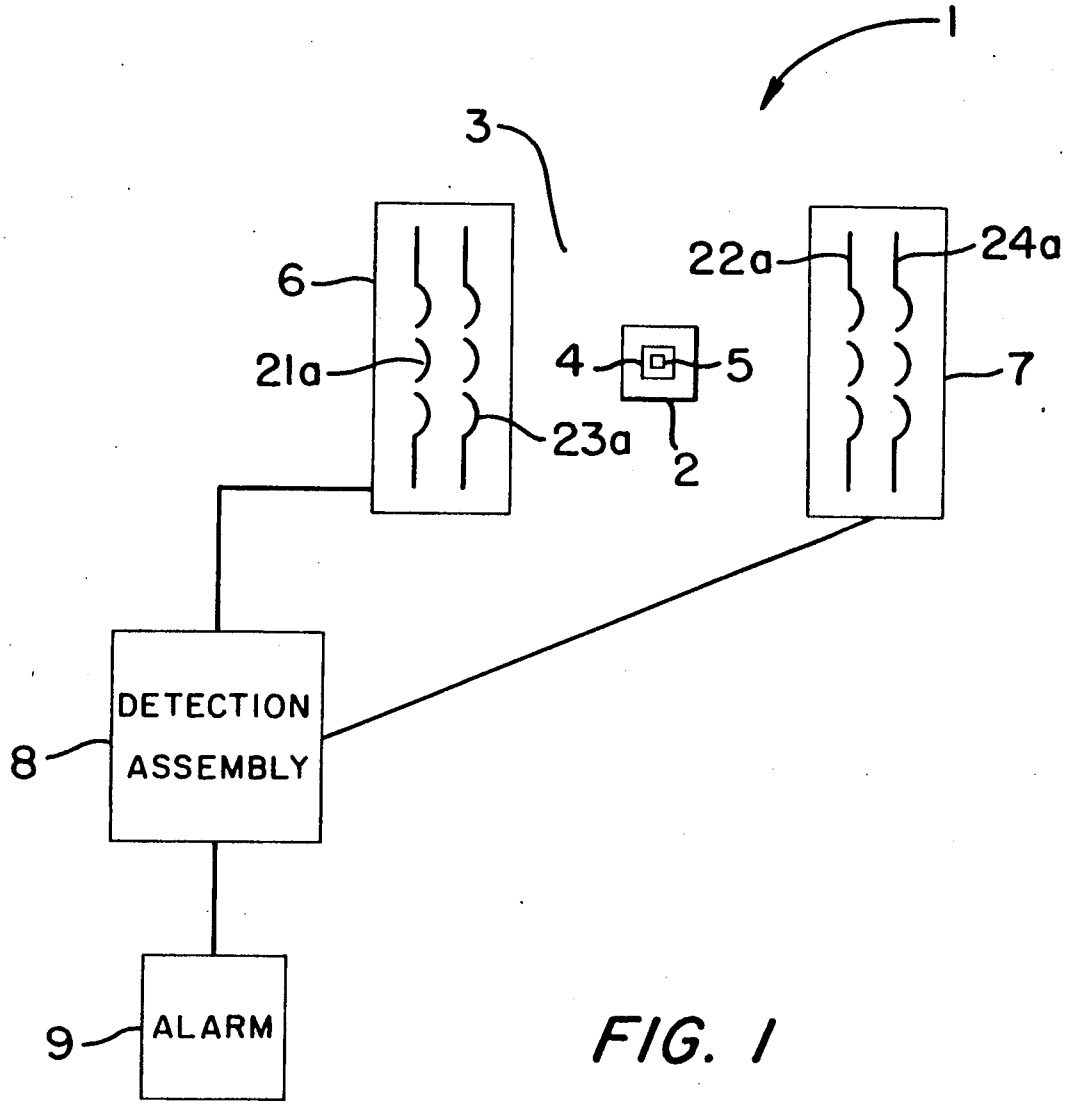
FIG. 1 shows the general configuration of a magnetic article surveillance system in accordance with the principles of the present invention.

FIG. 1 shows the overall general configuration of an article surveillance system 1 in accordance with the principles of the present invention. The system 1 is to be employed to detect the presence of an article 2 passing through an interrogation zone 3.

This is accomplished by providing each article with a tag 4 formed from or comprised of a magnetic marker 5. The marker 5 can comprise any one of a number of magnetic materials in strip, wire or other form having the capability of creating perturbations in a magnetic field transmitted into or established in the zone 3. Preferably, the magnetic material is such as to create perturbations at harmonics of the fundamental frequency $F_0$ of the transmitted field. Typical magnetic materials might be permalloy and super permalloy. Also, magnetic materials exhibiting a large Barkhausen discontinuity such as disclosed in U.S. Pat. No. 4,660,025, assigned to the same assignee hereof, might also be used. The magnetic marker 5 may also be configured to be deactivatable in accordance with known practices.

Magnetic energy is transmitted into the zone 3 via one or more magnetic field transmitter coils. These coils are housed in and distributed amongst one or more pedestals, shown as pedestals 6 and 7, bordering the zone 3. Similarly, magnetic energy, including the perturbation energy created by the presence of any markers 5 in the zone 3, is received by one or more magnetic field receiver coils. These coils are also housed and distributed amongst the pedestals 6 and 7.

A control system and detection assembly 8 provides overall control of the operation of the system 1. This assembly, in response to the transmitted and received magnetic energy, makes a determination as to the presence in the zone 3 of articles 2 bearing tags 4 having a valid markers 5 (i.e., valid articles). When a valid article is detected, the assembly 8 activates the alarm 9 to indicate presence of the article.

In accordance with the principles of the present invention, the configuration and arrangement of the one or more magnetic transmitters and receivers in the system 1 and the control of the operation of same by the control and detection assembly 8 to provide different modes of operation is such that the pick rate for the system 1 is relatively high, while the false alarm rate for the system is relatively low for metallic objects of both high and low masses. More particularly, this is achieved in the FIG. 2 embodiment of the system 1 by including in the system at least a first transmitter 21 and, preferably, also a second transmitter 22, and, furthermore, a first receiver 23 which is more closely coupled magnetically to the first transmitter 21 than to the second transmitter 22 and a second receiver 24 which is more closely coupled magnetically to the second transmitter 22 than to the first transmitter 21. It is further achieved in the FIG. 2 embodiment by the assembly 8 controlling the on and off or active and inactive states of the transmitters 21, 22 and the receivers 23 and 24 to establish and switch between first and second modes of operation for the system. In the first mode of operation, the transmitter 21 and receiver 24 are in their active states and the transmitter 22 and receiver 23 are in their inactive states and in the second mode of operation both transmitters 21, 22 and both receivers 23 and 24 are in their active states.

The first mode of operation is thus a transmit/receive mode (relatively low magnetically coupled transmitter and receiver in operation) and the second mode of operation is a transceiver mode (relatively high magnetically coupled transmitters and receivers in operation). By appropriately switching between these modes of operation and by utilizing specified different article detection criterion in the two modes, as will be discussed below, the aforementioned high pick rate and low false alarm rate for objects of different masses for the system 1 is achieved.

Figure 2:
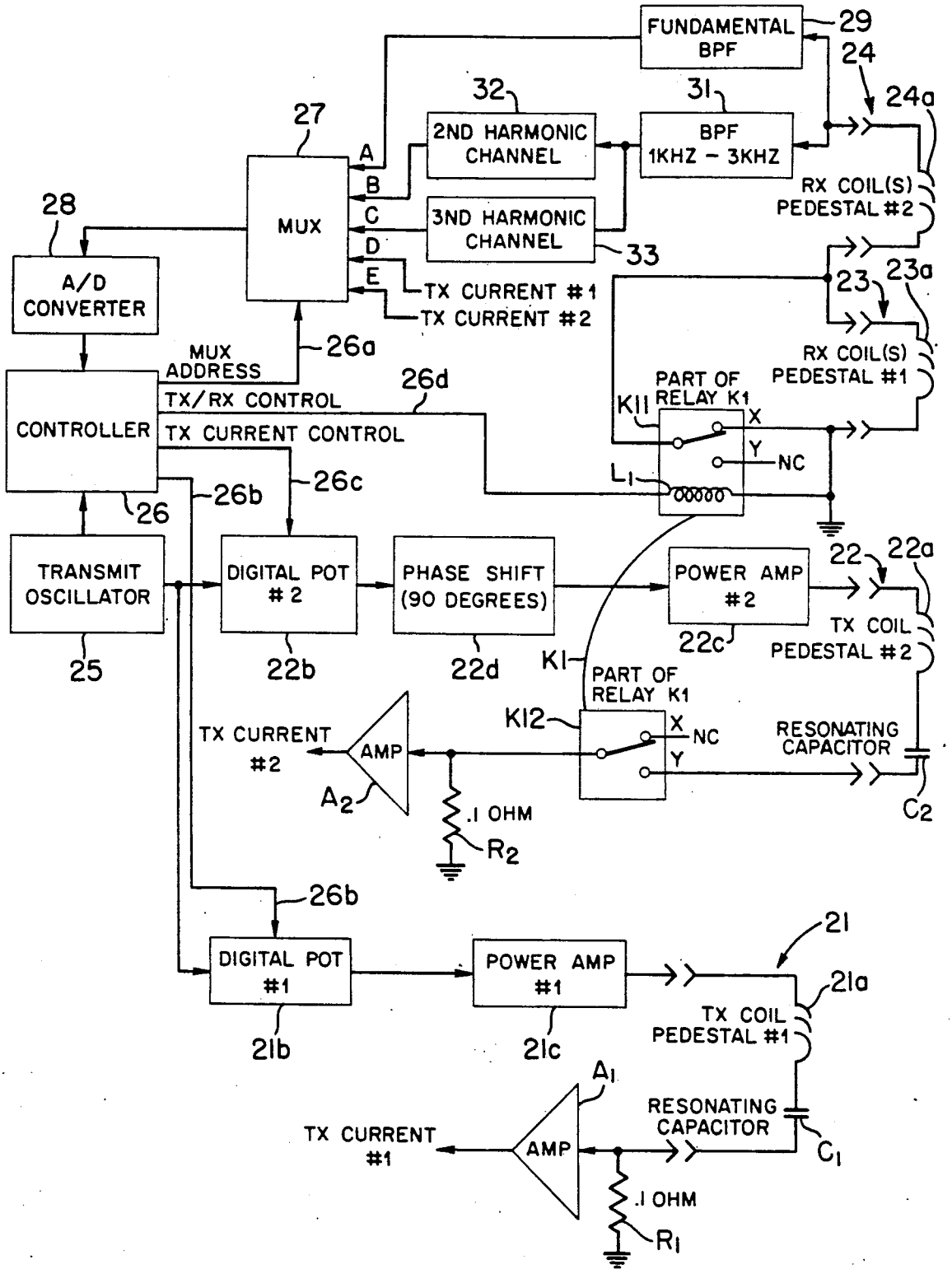
FIG. 2 shows a first embodiment of the system of FIG. 1 in greater detail.

As can be seen in FIGS. 1 and 2, the transmitter 21 and receiver 23 are provided with respective transmitter and receiver coils 21*a* and 23*a*. These coils are both arranged in close proximity in the pedestal 6 to achieve the desired high magnetic coupling between the transmitter 21 and receiver 23.

Likewise, the transmitter coil 22*a* of the transmitter 22 and the receiver coil 24*a* of the receiver 24 are arranged in close proximity in the pedestal 7. This provides the desired high magnetic coupling between transmitter 22 and receiver 24. Also, transmitter coil 22*a* and receiver coil 23*a* are spaced by the system width, i.e., the spacing between the pedestals 6, 7, the transmitter 21 and receiver 24 and the transmitter 22 and receiver 23 have a relatively low magnetic coupling as is desired for these transmitter/receiver pairs.

For driving the transmitters 21 and 22, a common master oscillator 25 provides A–C drive signals at a fundamental frequency $F_0$. The drive signals are fed through respective digital potentiometers 21*b* and 22*b*, which permit adjustment of the signal levels, and through respective power amplifiers 21*c*, 22*c* which convert the A–C voltages to high level output voltages for the respective coils 21*a* and 22*a*. Between the potentiometer 22*b* and amplifier 22*c*, a 90° phase-shifter 22*d* is provided for shifting the phase of the output of the potentiometer 22*b* by 90°. The coils 21*a* and 22*a* are thus driven in phase quadrant resulting in magnetic fields in the zone 3 which are also in phase quadrant.

In the FIG. 2 embodiment, the receiver coils 23*a* and 24*a* are connected electrically in series. This results in a combined received signal being developed when both receivers are active.

For effecting the first and second operating modes, the FIG. 2 embodiment is provided with a contact relay K1 having relay parts K11 and K12. The relay part K11 is connected in circuit with the receiver coil 23*a* and the relay part K12 is connected in circuit with the transmitter coil 22*a*.

Each relay part has two states X and Y which are controlled by a common relay coil $L_1$. In the X state of relay part K11, the relay part shunts the coil 23*a*, thereby rendering the receiver 23 inactive. In its Y state, the relay part K11 opens this shunt, thereby rendering the receiver 23 active. Likewise, the relay part K12 renders the transmitter 22 inactive in its X state, by opening the connection of the transmitter coil 22*a* and ground, and renders the transmitter 22 active in its Y stat by closing this connection to ground.

As can be appreciated, by controlling the current to the coil $L_1$ of the relay K1, the transmitter 22 and the receiver 23 can be rendered active and inactive. This enables the system 1 to be placed in the first operating mode (transmitter 21 and receiver 24 active, transmitter 22 and receiver 23 inactive) and in the second operating mode (both transmitters 21 and 22 and both receivers 23 and 24 active).

As above-discussed, the control assembly 8 of the system 1 brings about the first and second operating modes of the system 1. In the FIG. 2 embodiment, the assembly 8 comprises a controller 26 which, preferably, is in the form of a program controlled microcomputer. The controller 26 develops the necessary control signals for controlling the system 1 as well as processes information received from the receivers 23, 24 and transmitters 21, 22 to make a determination as to the presence of a valid article in the zone 3.

The controller 26 receives the aforesaid information from the transmitters and receivers by addressing, via an address line 26*a*, ports A–E of a multiplexer circuit 27. The multiplexer circuit 27 feeds the signal of an addressed port to the controller 26 through an A/D converter 28 which converts the signal to a digital signal, typically a binary encoded signal, which can be read by the controller.

As indicated in FIG. 2, the multiplexer signals at ports D and E are indicative of the current in the transmitter coils 21*a* and 22*a*, respectively at the fundamental frequency $F_0$. These signals are developed by an arrangement of a capacitor, resistor and current sensing amplifier connected to each coil (identified as $C_1$, $R_1$ and $A_1$ and $C_2$, $R_2$ and $A_2$ in FIG. 2).

The multiplexer ports A, B and C, in turn, receive signals indicative of the components of the received magnetic signals at the fundamental frequency, second harmonic and third harmonic, respectively, of the transmitted magnetic energy. Thus, these signals are indicative of the received components at the frequencies $F_0$, $2F_0$ and $3F_0$, respectively.

The component of the received signal at the fundamental frequency $F_0$ is developed by coupling a portion of the received energy through a bandpass filter (BPF) 29 whose pass band is centered at the fundamental frequency $F_0$. This filter extracts the component at the fundamental $F_0$, amplifies this component and then makes it available to the port A of the multiplexer 27.

A second bandpass filter (BPF) 31 receives a second portion of the received signal and it extracts from this signal the components thereof at the second and third harmonics $2F_0$ and $3F_0$. The extracted components are then separated by channel separators 32, 33, which are otherwise similar except that one is designed to operate at the second harmonic and the other at the third harmonic.

Typically, each of the separators 32, 33 may include a bandpass filter having a high Q and centered at the harmonic to be separated, a full wave rectifier and a DC integrator. The full wave rectifier converts the negative excursions of the harmonic output of the filter to positive excursions, while the DC integrator converts the output of the full wave rectifier to a DC value which is directly proportional to the harmonic amplitude.

As above indicated, the controller 26 makes use of the signals at the ports A–E of the multiplexer 27 to make its determination as to the presence of a valid article in the zone 3 and to also develop control signals for the system operation. In addition to the address control signal on line 26*a*, the controller 26 provides transmitter current control signals on lines 26*b*, 26*c* to the digital potentiometers 21*b* and 22*b*. These signals control the current levels in the transmitter antenna coils 21*a* and 22*a*, respectively. The controller also generates a mode control signal on the line 26*d* for addressing the relay coil $L_1$. This signal controls the state of the relay $K_1$ and, therefore, the active or inactive states of the transmitter 22 and rcceiver 23.

The operation of the system 1 is carried out by the controller 26 in accordance with program control. This operation includes an initialization phase where the conditions of the environment of the system are used to initially calibrate the system, i.e., develop initial or base levels for system parameters including thresholds for detection criteria. It also includes a surveillance phase where the system operates to evaluate the presence of valid articles in the interrogation zone.

Figure 3:
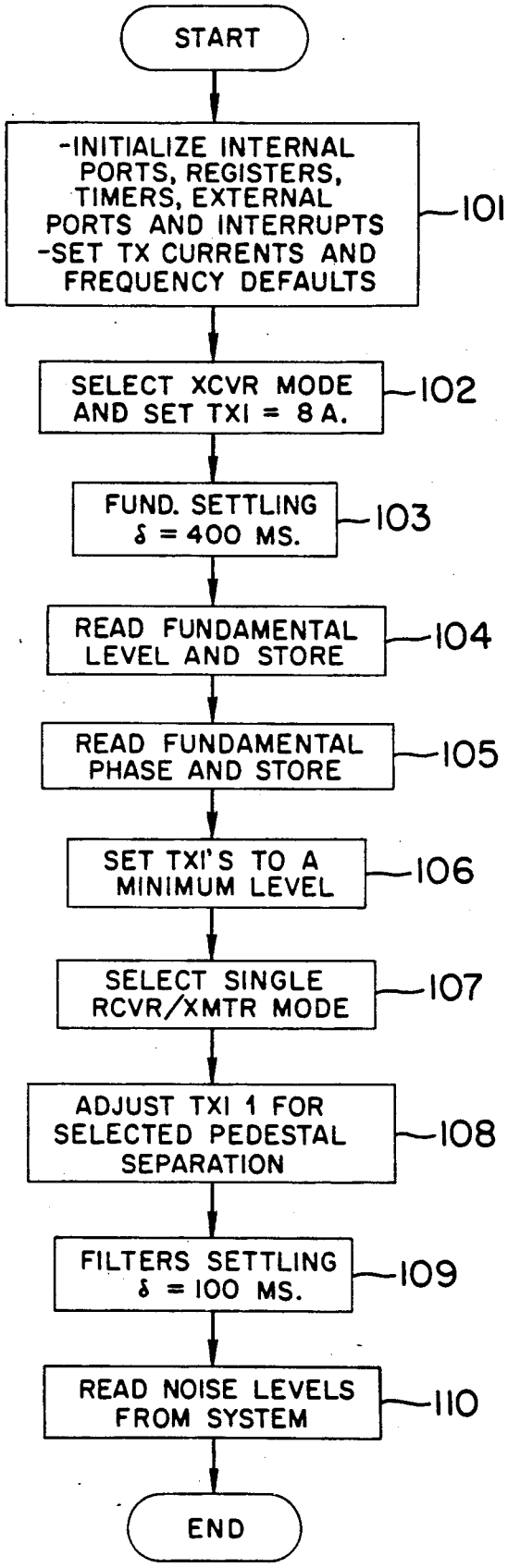
FIG. 3 shows a flow diagram of the system operation carried out by the controller of FIG. 2 during an initialization phase of operation of the system.

FIG. 3 shows a flow diagram of an illustrative initialization phase of operation of system 1. This operation is carried out when the system is first powered up. As indicated, at this time, the controller proceeds to step 101 where it initializes its internal registers, timers, interrupts, and external input/output ports. This places the controller 26 in operating condition.

Once the controller 26 is initialized the controller in step 102 sets the system 1 to operate in the second or transceiver mode at a preselected transmission level. This is brought about by the controller 26 providing a signal on the line 26*d* to the coil $L_1$ of the relay $K_1$, thereby placing the relay parts K11 and K12 in their Y states. As a result, both transmitters 21, 22 and both receivers 23, 24 are placed in their active states.

The controller then signals, via lines 26*b*, 26*c*, the digital potentiometers 21*b* and 22*b*, adjusting them until the current through each transmitter coil 21*a* and 22 reaches a predetermined first current level, shown as 8Ap-p. The transmitter coil currents are read during this adjusting operation through the A/D converter 28 by the controller addressing the multiplexer ports D and E. Once the currents have reached the 8Ap-p level, the controller 26 proceeds to step 103 where it waits a preselected time, shown as 400 msec, for stabilization of the system 1 components, particularly the fundamental BPF 29.

The controller 26 then proceeds to step 104 where it addresses port A of the multiplexer 27 to read through the A/D converter the amplitude of the fundamental component in the composite signal received by the receiver coils 23*a* and 24*a*. Since the waveform from the BPF 29 is an A–C signal, the controller 26 address the port A several times to sample the signal over one or more cycles and stores the peak sample as the fundamental amplitude.

Once this amplitude has been stored and read and the controller moves to step 105. At this step, the phase of the fundamental component is also read and stored. This phase measurement is accomplished by the controller measuring the time differential between the zero crossings of the fundamental frequency signal generated by the transmit oscillator 25 and the zero crossings of the A–C signal of the fundamental component from the BPF 29.

The amplitude and phase measurements taken in steps 104 and 105 serve as initial phase and amplitude readings for the received fundamental component. These readings are used in the system's surveillance phase of operation to be discussed below, to determine whether the received fundamental component amplitude or phase has changed.

Having completed steps 104–105 to establish fundamental amplitude and phase in the second or transceiver mode of operation, the controller 26 now proceeds to steps 106–110 where it switches operation of the system to the transmit/receive mode. In this mode, the controller will now establish initial levels of the second and third harmonic components in the received signal.

This is accomplished by the controller, via lines **26*b* and 26*c*, first adjusting the digital potentiometers 21*b*, 22*b* to minimize the current through both transmitter coils 21*a*, 22*a*. The cotnroller 26 then signals, via line 26*d*, the relay coil $L_1$ to change the states of the relay parts K11 and K12 from their Y to their X states. This places transmitter coil 22*a* and receiver coil 23*a*** in their inactive states.

The controller then resets digital potentiometer **21*b*, via line 26*b*, to bring the transmit current in transmitter coil 21*a* to a second predetermined current level, typically 7.0Ap-p. The controller then waits a predetermined time, shown as 100 msec, to allow the system components, particularly the BPF filters to stabilize. After the filters stabilize, the controller now reads the signal levels of the second and third harmonic components in the received signal by addressing ports B and C of the multiplexer 27. This allows the signals at these ports to pass via the A/D converter 28** to the controller.

The read second and third harmonic signal levels are also stored by the controller 26 for subsequent use in the surveillance phase of operation of the system. These signals are used as initial noise levels for the second and third harmonic channels.

Having completed the initialization operation at the step 110, the controller 26 now turns to the surveillance phase of operation. In this phase of operation, the controller 26 repetitively carries out a surveillance procedure once every cycle of the fundamental frequency $F_0$ using an interrupt signal at that frequency. Typically, the frequency $F_0$ might be 530 Hz, so that the surveillance procedure is carried out every 1.89 msec.

Figure 4A:
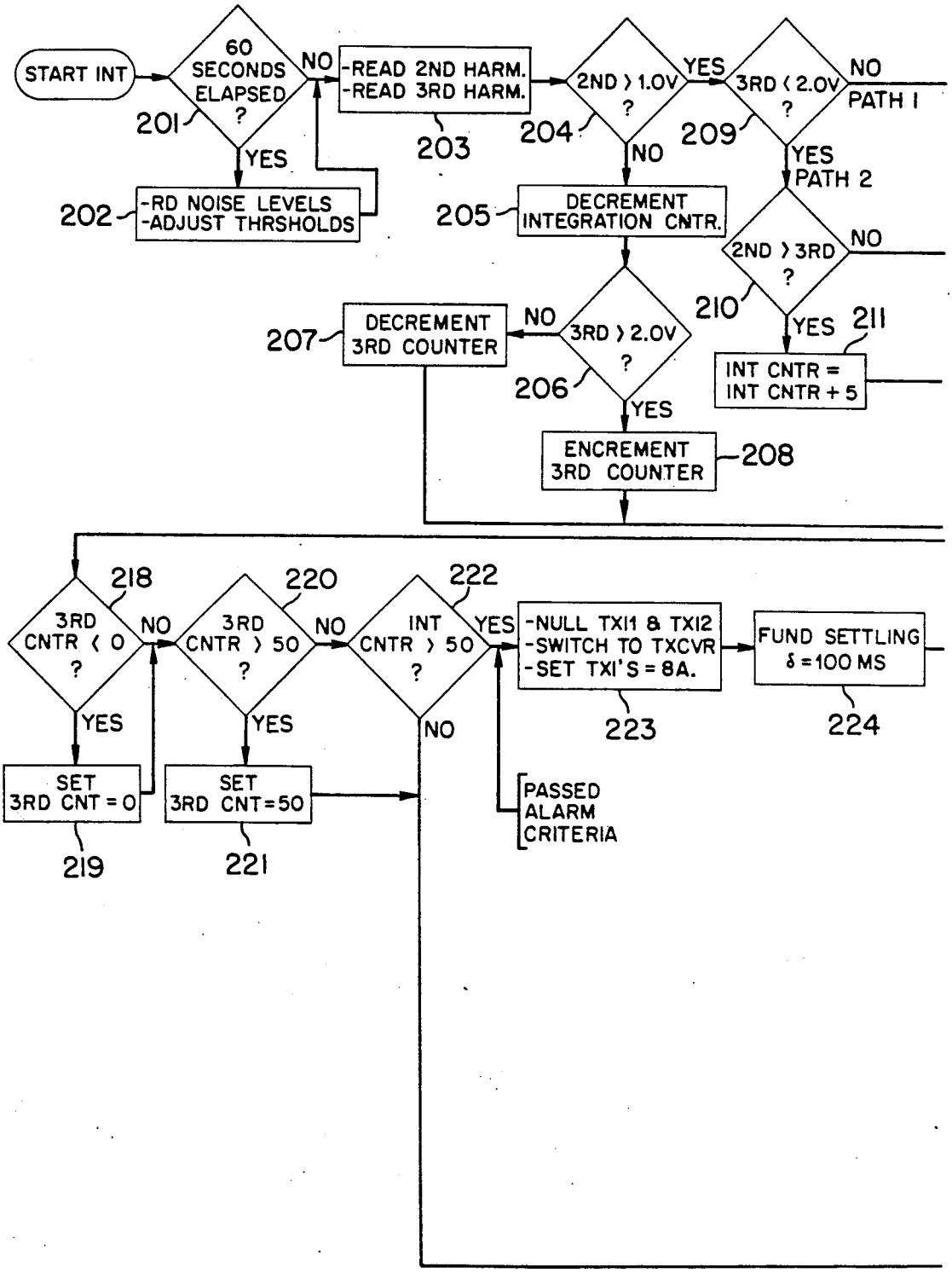
FIGS. 4A and 4B show a flow diagram of the system operation carried out by the controller of FIG. 2 during a surveillance phase of operation of the system.
Figure 4B:
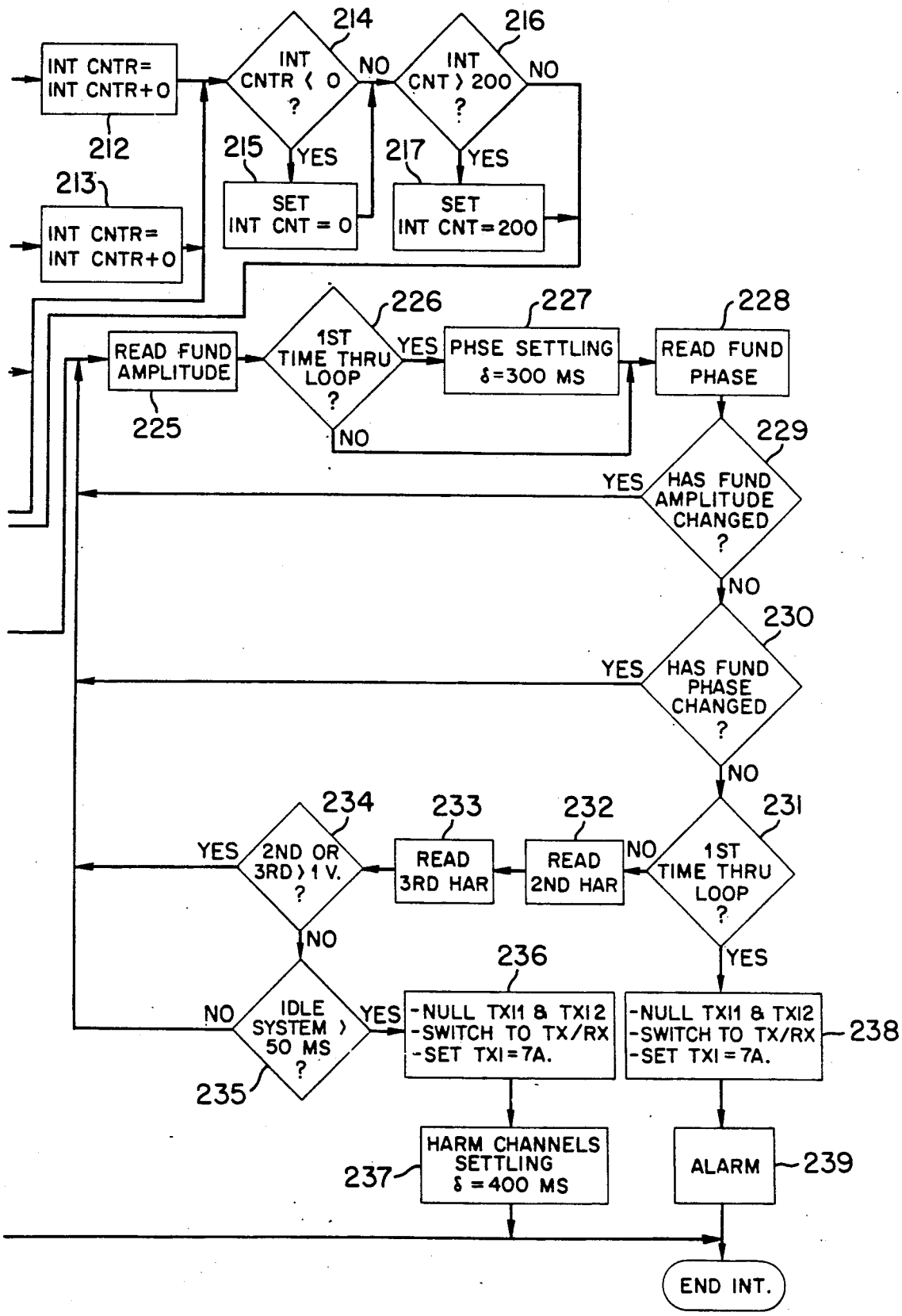

The surveillance procedure begins with the system 1 in the transmit/receive mode as this was the mode existing at the end of the initialization operation. FIGS. 4A and 4B show a flow diagram of an illustrative procedure. The procedure begins at a step 201, where the controller 26 checks to see if 60 seconds have elapsed. If it has, the controller then proceeds to update the noise levels in the second and third harmonic channels. It does this in step 202 where it reads the levels of the second and third harmonic components of the received signal. This is done in a similar manner as discussed for step 110 in the initialization operation. The read levels are averaged with the values previously stored to establish new noise levels for the second and third harmonic channels. These noise levels are then stored, after being used to adjust the threshold values in the criterion used later on in the surveillance procedure for determining the presence of valid articles.

Following updating of the noise levels in step 202 or if 60 seconds have not elapsed, the controller proceeds to step 203 where the levels of the second and third harmonic components in the received signal are again read and stored. This reading is likewise accomplished following the procedure in step 110 of the initialization operation. These stored values are then used to make a first determination as to the presence of a valid article in the interrogation zone.

This first determination is made by the controller 26 carrying out a first set of decision criteria which are set forth in steps 204–222 of the surveillance procedure. This first set of decision criteria may be empirically or otherwise established. In the present case, the criteria are based upon empirical data developed using tags having specially designed magnetic markers. In particular, the markers are made from magneto restrictive material and have a length to area ratio such that the demagnetization field is small compared to the drive field. This ensures enough field to saturate the material and obtain the maximum non-linearities in the perturbation of the magnetic field. This will result in the marker generating the desired harmonics for system operation.

With such tags, the empirical data developed indicates that valid articles will likely generate a second harmonic component in the received signal whose level is between certain threshold levels. It also indicates that metallic objects will likely generate a third harmonic component in the received signal whose level is above a certain threshold level and that the level of the second harmonic component will likely exceed the level of the third harmonic component in the presence of a valid article.

Accordingly, the controller 26 first checks the levels of the second and third harmonic components in the received signal relative to preselected thresholds, shown as 1.0 VDC and 2.0 VDC, which have been previously set based in part on the already read noise levels. If the level of the second harmonic component is less than 1.0 VDC this indicates that it is less likely that there is a valid article present in the interrogation zone. As a result, this is reflected by decrementing by one the count of a second harmonic integration counter.

The controller 26 then checks the level of the third harmonic component in the received signal. If the level of this component is greater than 2.0 VDC, this indicates that it is more likely that a metal object is in the interrogation zone (a potential false alarm object). The controller thus reflects this likelihood by incrementing by one the count of a third harmonic integration counter. On the other hand, in the event the level of the third harmonic component is less than 2.0 VDC, this is indicative that it is less likely that a metal object is in the zone. In this case, the third harmonic integration counter is decremented by one to reflect this lesser likelihood.

If the level of the second harmonic signal checked in step 204 is greater than the 1.0 VDC threshold, this is indicative of the likely presence of a valid article in the zone. In this case, the controller 26 then also checks the level of the third harmonic component in the received signal. If the level of the third harmonic component is greater than 2.0 VDC than this again is indicative that there is more likelihood that there is a metal object and not a valid article in the zone. In this case, the second harmonic integration counter is not incremented.

If the level of the third harmonic component is, however, less than 2.0 VDC than the ratio of the levels of the second and third harmonic signals is checked. If this comparison shows the second harmonic component level to be greater than that of the third harmonic component, this is indicative of a substantial likelihood of the presence of a valid article in the zone and the second harmonic integration counter is incremented by 5. If this comparison shows the third harmonic component level to be greater than the second harmonic component level, this is indicative that it is more likely that a metal object is in the zone and not a valid article. Hence, the second harmonic integration counter is not incremented.

Once steps 204–212 have been completed, the controller 26 then checks both the second and third harmonic integration counters for an overflow condition. If the count in second harmonic integration counter is less than zero, the counter is reset to zero, and if the count in the counter is greater than a preselected value, shown as 200, it is set at this value. If the count in the third harmonic integration counter is less than zero, the counter is reset to zero, and if the count in this counter is greater than a further preselected value, shown as 50, it is set to this value.

Having checked the counters in steps 214–221, the controller then proceeds to the step 222 where it makes a determination as to the presence of a valid article in the zone based on the counts in the counters. If the count in the second harmonic integration counter is greater than 50 and the count in the third harmonic counter is less than 50, the controller 26 reaches a first determination that a valid article is present in the zone. In this case, the surveillance procedure continues to make a second determination as to the presence of a valid article in the zone.

This second determination, however, as discussed above, is made by switching the system 1 into the transceiver mode and by then using a different set of decision criteria than were used to make the first determination. This set of determination criteria are based on imperical data which indicates that the occurrence of a phase or amplitude shift in the fundamental component of the received signal in the transceiver mode of operation is indicative of a metal object in the zone and not a valid article. This remaining portion of the surveillance procedure is set forth in steps 223–239 discussed below.

If in reaching step 222, the count of the second harmonic integration counter is less than 50 or the count of the third harmonic integration counter is greater than 50, then the controller 26 makes a first determination that a valid article is not present in the zone. In this case, the surveillance procedure is brought to an end to await the next interrupt which restarts the procedure from step 201.

Assuming, however, that in step 222 the first determination made by the controller is that a valid article is present in the zone 3, the surveillance procedure, as above-discussed, then proceeds to switch the system 1 to the second or transceiver mode to make its second determination. If this second determination confirms the presence of a valid article, the system is then alarmed via alarm 7.

More particularly, the controller 26 first switches from the transmit/receive mode to the transceiver mode by initially minimizing the transmit current in transmitter coils 21*a* and 22*a*. This is accomplished by the controller, via lines 26*b*, 26*c*, setting digital potentiometers 21*b* and 22*b* to their minimum resistances. The controller 26 then signals, via line 26*d*, the coil $L_1$ of relay K1 to switch the states of relay parts K11 and K12 from their X states to their Y states. This brings the transmitter 22 and the receiver 23 to their active states. The controller 26 then resets digital potentiometers 21*b* and 22*b* until the current through each transmitter coil 21*a* and 21*b* reaches the first predetermined current level, i.e., 8Ap-p. The controller reads these currents through A/D converter 28 by addressing ports D and E of multiplexer 27. Once the current through each coil has been set at the first predetermined level, the controller 26 delays for a predetermined amount of time, shown as 100 msec, to ensure that the system components, particularly the fundamental BPF 29, stabilizes before continuing with the further operation.

After elapse of the 100 msec period, the controller 26 then addresses multiplexer port A to read through A/D converter 28 the amplitude of the component of the received signal at the fundamental frequency $F_0$. This is carried out by the controller addressing the port A several times over one or more cycles of the signal and storing the peak sample as the amplitude of the fundamental component.

If this is the first time that the amplitude of the fundamental is being read in this surveillance period, i.e., the first time through the loop, the controller 26 delays a predetermined time, shown as 300 msec, before it proceeds to measure the phase of the fundamental component. In making this phase measurement, the controller measures the time differential between the zero crossings of the signal generated by the transmit oscillator 25 and the zero crossings of the the fundamental component.

Having read the amplitude and phase, the controller 26 then compares the read values with the stored readings taken during the initialization procedure. If the amplitude or phase of the fundamental component have changed from these initial readings, the controller 26, as above-indicated, recognizes this change as indicative of a metal object and not a valid article in the zone. Accordingly, the second determination is that a valid article is not present in the zone. Since, at this point, the second determination of the controller does not confirm the earlier first determination, the system 1 is not alarmed. Instead, the controller 26 proceeds to steps 232–237. In these steps, the controller switches the system 1 to the transmit/receive mode after the fundamental component of the received signal has returned to its initial condition and the level of the second and third harmonics of the received signal have fallen below a preselected threshold, shown as 1.0 VDC.

More particularly, as a result of steps 228 and 229, if either the amplitude or phase of the fundamental component has changed, the controller 26 continues to return the system to step 225 until no change is registered, i.e., until the amplitude and phase of the fundamental component have returned to their initial conditions. At this point in time, the amplitude of the fundamental has necessarily been read more than once, i.e., the operation has gone through the one loop more than once, so that the controller 26 again continues to return the system 1 to step 225, until the levels of the second and third harmonics have both gone below 1.0 VDC and have remained there a predetermined time, shown as 50 msec.

Once the fundamental of the received signal has returned to its initial phase and amplitude, and the second and third harmonics of the received signals are at levels below 1.0 VDC for a 50 msec period, the controller 26 then switches the system 1 to the transmit/receive mode. This is again accomplished by minimizing the current through both transmitter coils, signaling the relay coil $L_1$ of relay K1 so as to place the transmitter 22 and receiver 23 in their inactive states and then resetting the transmit current in transmitter coil 21*a* to the second predetermined level of 7.0Ap-p. Once the system 1 returns to the transmit/receive mode, a delay, shown as 400 msec, is implemented to allow the system components, particularly the BPFS, to stabilize. After this time, the controller awaits the next interrupt to restart the surveillance procedure at step 201.

If there has been no change in the phase or amplitude of the fundamental component of the received signal in steps 229 and 230, the controller 26 recognizes this as indicating that there is no metal object in the zone and, hence, that there is a valid article in the zone. In this case, the controller's second determination is thus that a valid article is present. This second determination, therefore, confirms the first determination and controller then proceeds to step 239 where it alarms the system. Prior to alarming the system, the controller 26 switches the system 1 to the transmit/receive mode at step 238. This occurs as previously discussed above for the step 236. The system 1 is thereby set to again repeat the surveillance procedure at step 201 on the next interrupt.

By following the above surveillance procedure, it has been found that the pick rate of the system 1 is relatively high and the false alarm rate for both high and and low mass metal objects is relatively low. Thus, watches, shopping carts and deactivated markers can pass through the system with a significant degree of confidence that they will not cause the system to alarm. The system, therefore, performs with negligible false alarms for all types of metal objects.

In the embodiment of the system 1 shown in FIG. 2, a single relay K1 was used to control the active and inactive states of the transmitter 22 and the receiver 23 and, thereby to switch the operating mode of the system from the transmit/receive mode to the transceiver mode. As a result, control of the receiver and transmitter were dependent on one another.

Figure 5:
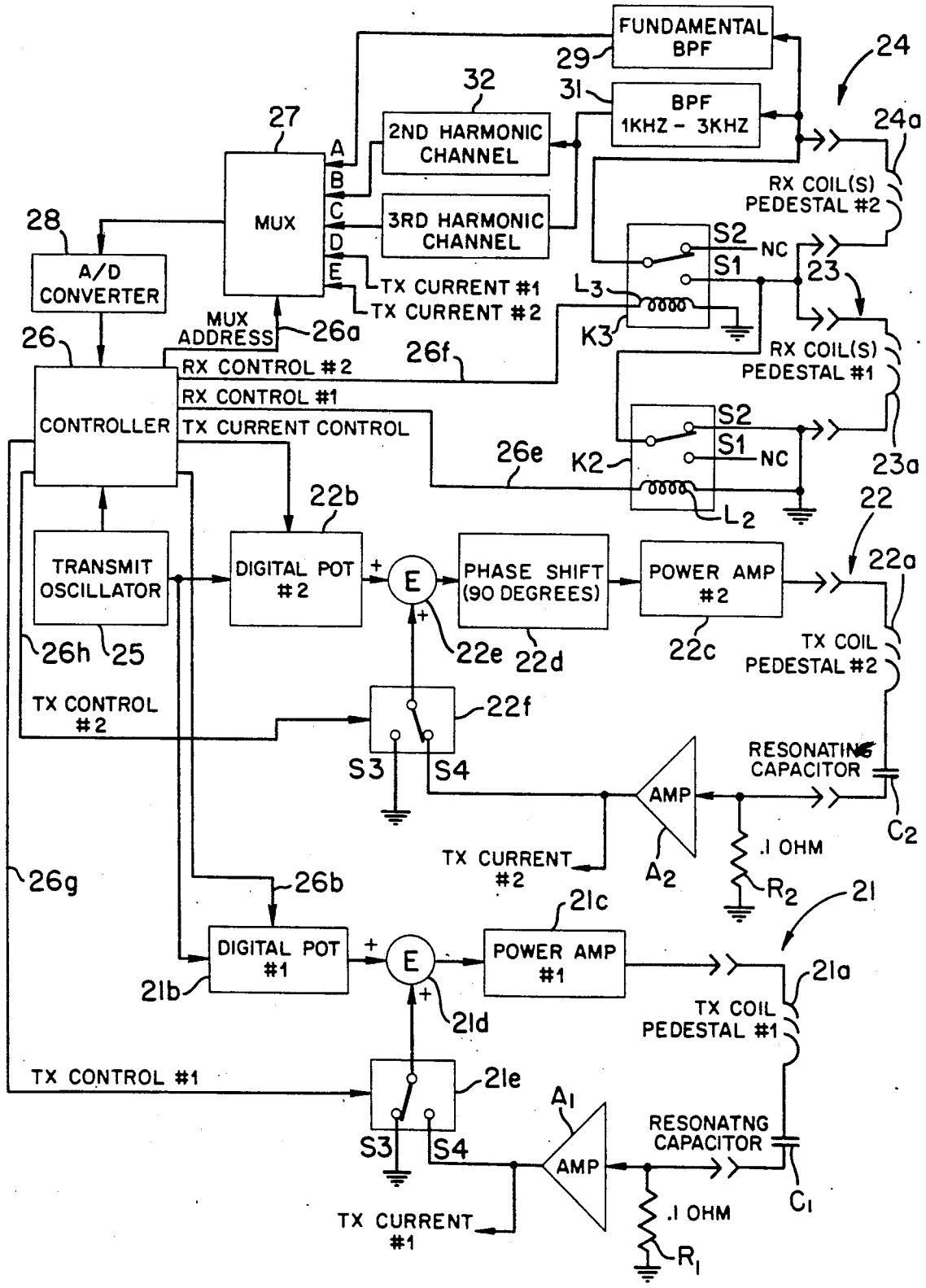
FIG. 5 illustrates the details of a second embodiment of the system of FIG. 1.

FIG. 5 shows a second embodiment of the system 1 wherein independent control of both transmitters 21 and 22 and both receivers 23 and 24 of the system 1 can be realized. With this type of control, both receivers 23, 24 can be placed in active state, both can be placed in inactive state and each can be placed in active state with the other in inactive state. The transmitters 21 and 22 can similarly be so controlled.

In accordance with the invention, this independent control is effected, in part, by modifying the FIG. 2 arrangement so as to provide independent relay control of each receiver. Thus a first relay K2 is placed in circuit with the receiver coil 23*a* and a second independent relay K3 is placed in circuit with the receiver coil 24*a*. These relays have coils $L_2$ and $L_3$ which are independently controllable by the controller 26 over lines 26*e* and 26*f*.

Each relay K2, K3 has two states S1 and S2. In the state S1, the relay K2 is open circuited, thereby placing its receiver coil 23*a* and receiver 23 in active state, while the relay K3 parallels or shunts its receiver coil 24*a*, thereby placing receiver 24 in an inactive state. In the state S2, the relay K2 shunts or parallels its receiver coil 23*a*, rendering receiver 23 inactive, while the relay K3 open circuits, rendering receiver 24 active. By selectively controlling the relay coils $L_2$ and $L_3$, the receivers can thus both be made active (K2 in state S1 and K3 in state S2), receiver 23 can be made active and receiver 24 inactive (K2 in stat S1 and K3 in state K1), receiver 23 can be inactive and receiver 24 active (K2 in state S2, K3 in state S2) and both receivers can be made inactive (K2 in state S2 and K1 in state S1). Thus, each receiver can be controlled independently of the other to obtain any combination desired.

In further accord with the invention, independent control is further achieved in the FIG. 5 embodiment by providing each transmitter circuit with a summer between its digital potentiometer and power amplifier and with an electronic switch which enables one input of the summer to be either grounded or connected to the current sensing amplifier used to generate transmit current for the controller 26. Each switch has a first state S3 which effects the former connection and a second state S4 which effects the latter connection. The summers and switches are shown as 21*d*, 22*e* and 21*e*, 22*f*, respectively, in FIG. 5. The switches 21*e*, 22*f* are controlled by controller 26 via lines 26*g* and 26*h*, respectively.

With this configuration, the transmitters 21 and 22 can both be placed in inactive state by appropriate setting of the digital potentiometers 21*b* and 22*b* with the switches 21*e* and 22*f* held in states S4 by the controller 26. Each transmitter may be made active by changing its digital potentiometer setting with its respective switch held in the state S3 and the switch of the other transmitter held in the state S4. This creates a feedback path in the inactive transmitter which prevents it from becoming active as a result of any induced field from the active transmitter. Both transmitters can also be placed in their active states again by suitable adjustment of their respective potentiometers with the switches 21*e* and 22*f* in their states S3.

By providing independent control of each receiver and transmitter, the controller 26 can automatically adapt the system 1 to the optimum configuration for each user location. Thus, the controller 26 can now establish the transmit/receive mode in two ways. As in FIG. 2, the controller can activate the transmitter coil 21*a* in pedestal 6 and the receiver coil 24*a* in pedestal 7. However, the controller 26 can also activate the transmitter coil 22*a* in the pedestal 7 and the receiver coil 23 in pedestal 6. Thus, the transmit/receive mode can now be accomplished with the transmitter which is less subject to interference due to metal objects, such as counters, or noise sources, such as electronic registers.

Also by adding the feedback circuitry to the transmitters, the switching relay in FIG. 1 can be replaced with electronic switches 21*e* and 22*f*, which are much smaller and cost less. This has been made possible by placing the switches at the output of the current sense amplifiers, $A_1$ and $A_2$, where the level of current is less, making the use of electronic switches practical.

While the invention has been illustrated above using two pedestals 6 and 7 and a highly coupled transmitter and receiver in each pedestal, it is within the contemplation of the invention to utilize other combinations of transmitters and receivers which can be operated in two or more modes to carry out the principles of the invention. FIGS. 6–9 illustrate other pedestal and transmitter configurations.

Figure 6:
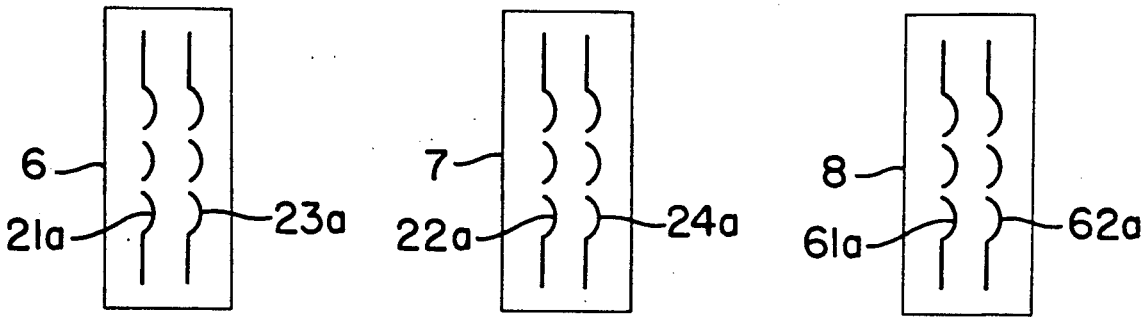
FIGS. 6–9 show further transmitter and receiver configurations which can used in the system of FIG. 1.

In FIG. 6, a third pedestal 8 is added to pedestal 6 and 7 to double the system width. The pedestal 8 includes a transmitter 61 and receiver 62 having transmitter and antenna coils 61*a* and 62*a*. In this configuration, in the first mode of operation of the system, the control assembly 8 would activate transmitter coil 22*a* and also receiver coils 23*a* and 62*a*. When a determination of the presence of an article is made in this mode, the control assembly would then switch to the second mode in which all transmit and receiver antennae would be active.

Figure 7:
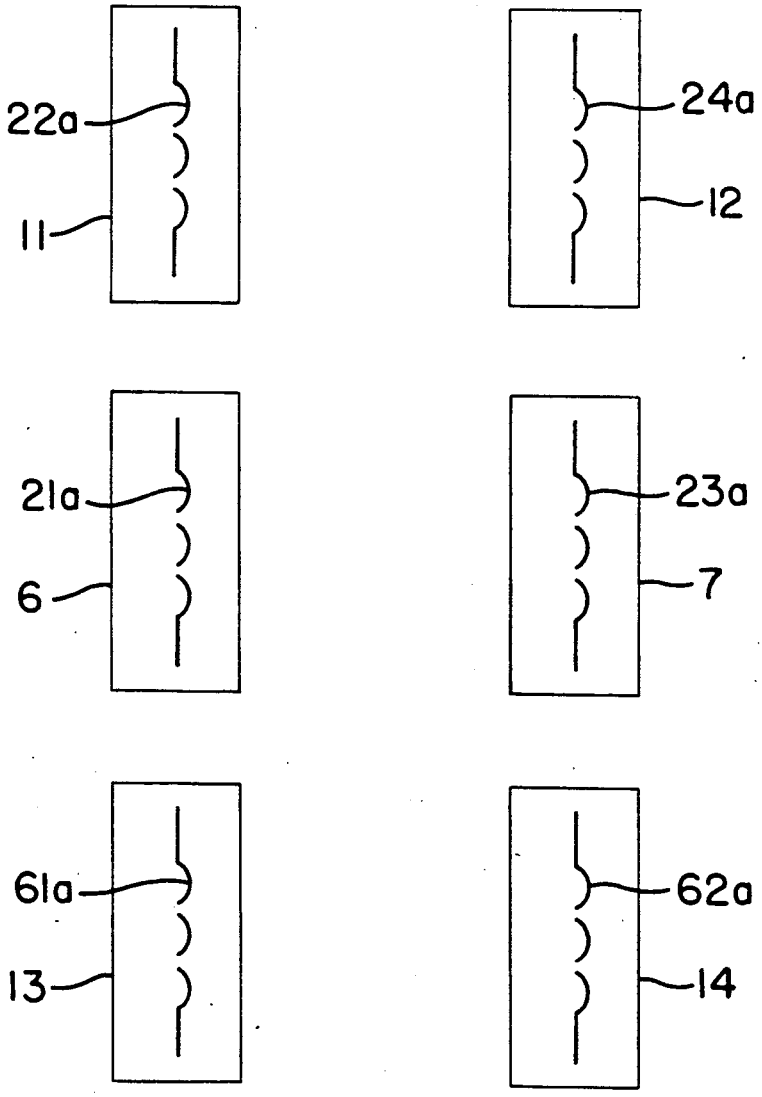

In the configuration of FIG. 7, the transmitters and receivers are not arranged in pairs in the pedestals. Instead, each transmitter and each receiver is arranged in its own pedestal and the pedestals arranged end to end. Thus, for three transmitters and three receivers, pedestals 11, 12, 13 and 14 are added. In the case shown, the transmitter and receiver antennae are arranged as shown. In this configuration, in the first mode of operation, transmitter and receiver combination 21*a* and 23*a* are active. Upon first determination of the presence of an article, transmitter and receiver antenna combinations 22*a*, 24*a* and 61*a*, 62*a* also become active. With this configuration, the same detection criteria can be used in the two modes, if the criteria are based on the 2F0 and 3F0 harmonic levels and inhibited by a shift in the fundamental.

Figure 8:
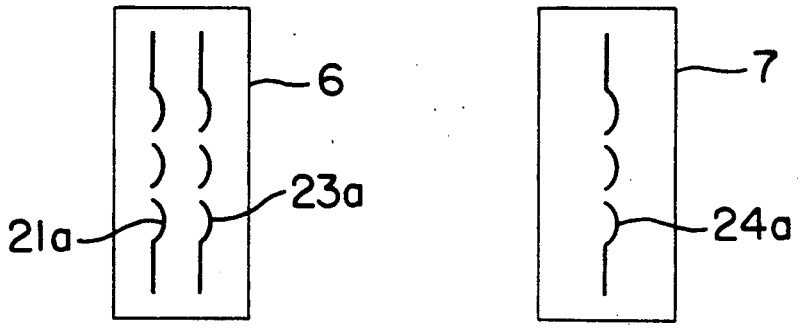

In FIG. 8, the two pedestals 6 and 7 are used, as in FIG. 1, except the transmitter 22 and transmitter antenna 22*a* have been removed. In this situation, in the first mode transmitter antenna 21*a* and receiver antenna 24*a* are active, while in the second mode receiver antenna 23*a* also becomes active.

Figure 9:
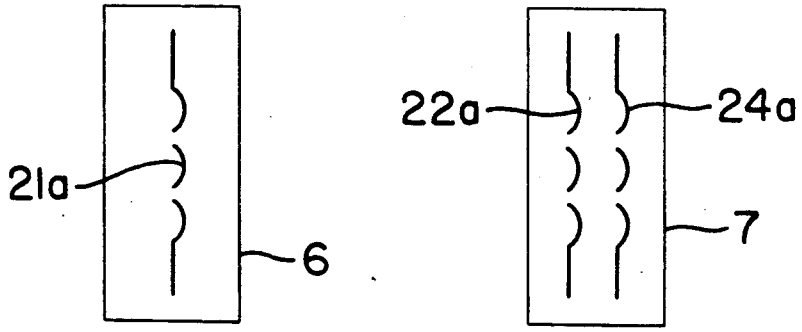

The FIG. 9 embodiment also uses the pedestals 6 and 7. Here, however, the receiver 23 and receiver antenna 23*a* have been removed. The first mode requires transmitter antenna 21*a* and receiver antenna 24*a* to be active and the second mode requires additionally transmitter 22*a* to be active.

It should also be noted that the criteria used to make the determinations as to the presence of a valid article, i.e., one bearing a valid tag, may also be changed or varied depending upon the particular circumstance. Thus, for example, instead of using the detection of the fundamental to make the second determination as in the procedure of FIGS. 4A and 4B this detection could also possibly be made using instead one or more harmonics of the fundamental.

In all cases, it is understood that the above-identified arrangements are merely illustrative of the many possible specific embodiments which represent applications of the present invention. Numerous and varied other arrangements can readily be devised in accordance with the principles of the present invention without departing from the spirit and scope of the invention.

What is claimed is:

1. An electronic article surveillance system for detecting the presence of articles passing through an interrogation zone, the articles carrying tags including magnetic markers, comprising:

first means from transmitting magnetic energy into said zone and for receiving magnetic energy including magnetic energy from said zone, said first means having at least first and second different modes of operation in which magnetic energy is transmitted into said zone;

and second means responsive to said first means and for controlling said first means to operate in at least said first and second modes in order to make a determination as to the presence of an article in said zone.

2. A system in accordance with claim 1 wherein:

said first means transmits said magnetic energy into said interrogation zone in said first mode of operation at a lower level than in said second mode of operation.

3. A system in accordance with claim 1 further comprising:

one or more of said magnetic markers.

4. A system in accordance with claim 1 wherein:

the transmitting characteristic of said first means is different in said first and second modes;

and/or the receiving characteristic of said first means is different in said first and second modes.

5. A system in accordance with claim 4 wherein:

the sensitivity of said first means in receiving magnetic energy is different in said first and second modes.

6. A system in accordance with claim 5 wherein:

said first means includes antenna means for receiving magnetic energy and the configuration of said antenna means is different in said first and second modes.

7. A system in accordance with claim 5 wherein:

said first means includes antenna means having electronic means for receiving magnetic energy and the gain of said electronic means is different in said first and second modes.

8. A system in accordance with claim 4 wherein:

the frequency of the transmitted magnetic energy is different in said first and second modes.

9. A system in accordance with claim 4 wherein:

said first means includes a plurality of transmitters and the frequencies of transmission of magnetic energy of said transmitters is different in said first and second modes.

10. A system in accordance with claim 4 wherein:

the amplitude of the magnetic energy in said zone is different in said first and second modes.

11. A system in accordance with claim 10 wherein:

said first means includes a plurality of transmitters having transmitter antennas;

and said control means selectively controls the active and inactive states of said antennas to realize said different amplitudes of the magnetic field in said first and second modes.

12. A system in accordance with claim 11 wherein:

said control of said inactive and active states includes control of the currents to one or more of said antennae.

13. A system in accordance with claim 11 wherein:

said second means comprises means for determining the presence of an article in said zone based on one or more criteria.

14. A system in accordance with claim 13 wherein:

said determining means makes a first determination based on a first set of criteria as to presence of an article in said zone when said first means is operating in said first mode and a second determination based on a second set of criteria as to the presence of an article in said zone when said first means is operating in said second mode.

15. A system in accordance with claim 14 wherein:

said first set of criteria are based on received magnetic energy components at one or more harmonics of the fundamental frequency of the magnetic energy transmitted into said zone;

and said second set of criteria are based on the received magnetic energy component at the fundamental frequency of the magnetic energy transmitted into said zone.

16. A system in accordance with claim 15 wherein:

said first set of criteria are based on the levels of the received magnetic energy components at least at the second and third harmonics of said fundamental frequency;

and said second set of criteria are based on the amplitude and/or phase of the received magnetic energy component at said fundamental frequency.

17. A system in accordance with claim 16 wherein:

said second means operates said first means in said first mode until said first determination is made indicating the presence of an article in said zone and said second means then switches said first means to said second mode for making said second determination.

18. System in accordance with claim 17 wherein:

said second means after switching said first means to said second mode awaits a predetermined period of time before said second means initiates the procedure for making said second determination.

19. A system in accordance with claim 18 wherein:

after said second means makes a second determination that indicates that an article is not present in said zone, said second means, after the component of said received signal at said fundamental frequency returns to an initial condition and the components of the received signal at the second and third harmonics are below a preselected level for a preselected time, switches operation of said first means to said first mode.

20. A system in accordance with claim 17 wherein:

said second means, after making a second determination that indicates an article is present in said zone, switches operation of said first means to said first mode.

21. A system in accordance with claim 2 wherein:

said first means includes: a first transmitter for transmitting magnetic energy into said zone; a first receiver for receiving magnetic energy including magnetic energy from said zone; a second receiver for receiving magnetic energy including magnetic energy from said zone; and said first and second receivers being such that the degree of coupling of magnetic energy between said first transmitter and said first receiver is greater than the degree of coupling of magnetic energy between said first transmitter and said second receiver;

and said second means during said first mode causes said first transmitter and second receiver to be in an active state and causes said first receiver to be in an inactive state and during said second mode causes said first transmitter and first receiver to be in an active state.

22. A system in accordance with claim 4 wherein:

said first means includes one or more transmitters and one or more receivers.

23. A system in accordance with claim 22 wherein:

said second means selectively controls the active and inactive states of said one or more transmitters and one or more receivers.

24. A system in accordance with claim 23 wherein:

said second means independently controls each of said transmitters and each of said receivers.

25. A system in accordance with claim 24 wherein:

said first means further includes a second transmitter for transmitting magnetic energy into said zone;

said first and second receivers being such that the degree of coupling of magnetic energy between said second transmitter and said second receiver is greater than the degree of coupling of magnetic energy between said second transmitter and said first receiver;

and said second means further controls said first means such that during said first mode said second transmitter is in an inactive state and during said second mode said second transmitter and second receiver are in an active state.

26. A system in accordance with claim 25 wherein:

said first means comprises an oscillator for generating a drive signal at said fundamental frequency;

said first transmitter comprises: a first transmitter coil responsive to said drive signal;

said second transmitter comprises: a second transmitter coil responsive to said drive signal;

said first receiver comprises a first receiver coil;

said second receiver comprises a second receiver coil;

and said first transmitter coil is in closer proximity to said first receiver coil than to said second receiver coil and said second transmitter coil is in closer proximity to said second receiver coil than to said first receiver coil.

27. A system in accordance with claim 26 wherein:

said second means further comprises: switch means for controlling said first receiver coil and said second transmitter coil during said first mode of operation.

28. A system in accordance with claim 27 wherein:

said switch means comprises a relay contact switch.

29. A system in accordance with claim 27 wherein:

said first and second receiver coils are connected in series.

30. A system in accordance with claim 26 wherein:

said second means further comprises:

first sensing means for sensing the current in said first transmitter coil;

and second sensing means for sensing the current in said second transmitter coil.

31. A system in accordance with claim 29 wherein:

said second means further comprises:

first filter means for filtering from the received signals in said first and second receiver coils said component at said fundamental frequency;

and second filter means for filtering from the received signals in said first and second receiver coils said components at said harmonics of said fundamental frequency.

32. A system in accordance with claim 30 wherein:

said second filter means filters individually a component of said received signal at the second harmonic of said fundamental frequency and a component of said received signal at the third harmonic of said fundamental frequency.

33. Apparatus in accordance with claim 26 wherein:

said second means comprises:

first and second switches for controlling said first and second transmitter coils, respectively; and third and fourth switches for controlling said first and second receiver antennas, respectively.

34. A method for use with an electronic article surveillance system for detecting the presence of articles passing through an interrogation zone, the articles carrying tags including magnetic markers, comprising:

transmitting magnetic energy into said zone and receiving magnetic energy including magnetic energy from said zone, said transmitting and receiving being capable of operating in at least first and second different modes of operation in which magnetic energy is transmitted into said zone;

and controlling said transmitting and receiving to operate in at least said first and second modes in order to make a determination as to the presence of an article in said zone.

35. A method in accordance with claim 34 wherein: said controlling of said transmitting is such that said magnetic energy transmitted into said interrogation zone in said first mode of operation is at a lower level than in said second mode of operation.

36. A method in accordance with claim 34 further comprising:

utilizing one or more of said magnetic markers.

37. A method in accordance with clam 34 wherein: said transmitting and receiving is carried out using a first transmitter for transmitting magnetic energy into said zone and first and second receivers for receiving magnetic energy including magnetic energy from said zone; said first and second receivers being such that the degree of coupling of magnetic energy between said first transmitter and said first receiver is greater than the degree of coupling of magnetic energy between said first transmitter and said second receiver;

and said controlling includes causing during said first mode said first transmitter and second receiver to be in an active state and said first receiver to be in an inactive state and during said second mode said first transmitter and first receiver to be in an active state.

38. A method in accordance with claim 34 wherein: the transmitting characteristic in the step of transmitting is different in said first and second modes;

and/or the receiving characteristic in the step receiving is different in said first and second modes.

39. A method in accordance with claim 38 wherein: the sensitivity of receiving magnetic energy in said receiving step is different in said first and second modes.

40. A method in accordance with claim 39 wherein: said receiving sensitivity is made different in said first and second modes by using different receiver antenna configurations in said first and second modes.

41. A method in accordance with claim 39 wherein: said receiving sensitivity is made different in said first and second modes by using different gains for the receiver antenna in said first and second modes.

42. A method in accordance with claim 38 wherein: said step of transmitting includes transmitting magnetic energy at different frequencies in said first and second modes.

43. A method in accordance with claim 38 wherein: said transmitting step is carried out using a plurality of transmitters and frequencies of transmission of magnetic energy of said transmitters which is different in said first and second modes.

44. A method in accordance with claim 38 wherein: said steps of transmitting includes transmitting magnetic energy in said zone at different amplitudes in said first and second modes.

45. A method in accordance with claim 44 wherein: said transmitting step is carried out using a plurality of transmitters having transmitter antennae;

and said step of controlling includes selectively controlling the active and inactive states of said antennae to realize said different amplitudes of the magnetic field in said first and second modes.

46. A method in accordance with claim 45 wherein: the controlling of said inactive and active states includes controlling of the currents to one or more of said antennae.

47. A method in accordance with claim 38 wherein: said step of controlling includes determining the presence of an article in said zone based on one or more criteria.

48. A method in accordance with claim 47 wherein: said determining includes making a first determination based on a first set of criteria as to presence of an article in said zone when said transmitting and receiving are operating in said first mode and a second determination based on a second set of criteria as to the presence of an article in said zone when said transmitting and receiving are operating in said second mode.

49. A method in accordance with claim 48 wherein: said first set of criteria are based on received magnetic energy components at harmonics of the fundamental frequency of the magnetic energy transmitted into said zone;

and said second set of criteria are based on the received magnetic energy component at the fundamental frequency of the magnetic energy transmitted into said zone.

50. A method in accordance with claim 49 wherein: said first set of criteria are based on the levels of the received magnetic energy components at least at the second and third harmonics of said fundamental frequency;

and said second set of criteria are based on the amplitude and/or phase of the received magnetic energy component at said fundamental frequency.

51. A method in accordance with claim 50 wherein: the controlling of said transmitting and receiving causes said transmitting and receiving to operate in said first mode until said first determination is made indicating the presence of an article in said zone and then switches said transmitting and receiving to operate in said second mode for making said second determination.

52. A method in accordance with claim 51 wherein: after switching said transmitting and receiving to said second mode a predetermined period of time is waited before said controlling initiates the procedure for making said second determination.

53. A system in accordance with claim 52 wherein: after a second determination is made indicating an article is not present in said zone, said controlling, after the component of said received signal at said fundamental frequency returns to an initial condition and the components of the received signal at the second and third harmonics are below a preselected level for a preselected time, switches said transmitting and receiving to said first mode.

54. A method in accordance with claim 51 wherein: said controlling, after making a second determination that indicates an article is present in said zone, switches said transmitting and receiving to said first mode.

55. A method in accordance with claim 38 wherein: said transmitting and receiving is carried out utilizing one or more transmitters and one or more receivers.

56. A method in accordance with claim 55 wherein: said controlling selectively controls the active and inactive states of said one or more transmitters and one or more receivers.

57. A method in accordance with claim 56 wherein: said controlling includes independently controlling each of said transmitters and each of said receivers.

58. A system in accordance with claim 56 wherein:

said transmitting and receiving further includes utilizing a second transmitter for transmitting magnetic energy into said zone;

said first and second receivers being such that the degree of coupling of magnetic energy between said second transmitter and said second receiver is greater than the degree of coupling of magnetic energy between said second transmitter and said first receiver;

and said controlling further causes during said first mode said second transmitter to be in a inactive state and during said second mode said second transmitter and second receiver to be in an active state.

59. An electronic article surveillance system for detecting the presence of articles passing through an interrogation zone, the articles carrying tags including magnetic markers, comprising:

first means for transmitting magnetic energy into said zone and for receiving magnetic energy including magnetic energy from said zone, said first means having at least first and second different modes of operation in both of which magnetic energy is transmitted into and received from said zone;

and second means responsive to said first means and for controlling said first means to operate in at least said first and second modes in order to make a determination as to the presence of an article in said zone.

60. An electronic article surveillance system for detecting the presence of articles passing through an interrogation zone, the articles carrying tags including magnetic markets, comprising:

first means for transmitting magnetic energy into said zone and for receiving magnetic energy including magnetic energy from said zone, said first means having at least first and second different modes of operation in which magnetic energy is received from said zone;

and second means responsive to said first means and for controlling said first means to operate in at least said first and second modes in order to make a determination as to the presence of an article in said zone.

61. A method for use with an electronic article surveillance system for detecting the presence of articles passing through an interrogation zone, the articles carrying tags including magnetic markers, comprising:

transmitting magnetic energy into said zone and receiving magnetic energy from said zone, said transmitting and receiving being capable of operating in at least first and second different modes of operation in both of which magnetic energy is transmitted into and received from said zone;

and controlling said transmitting and receiving to operate in at least said first and second modes in order to make a determination as to the presence of an article in said zone.

62. A method for use with an electronic article surveillance system for detecting the presence of articles passing through an interrogation zone, the articles carrying tags including magnetic markers, comprising:

transmitting magnetic energy into said zone and receiving magnetic energy including magnetic energy from said zone, said transmitting and receiving being capable of operating in at least first and second different modes of operation in which magnetic energy is received from said zone;

and controlling said transmitting and receiving to operate in at least said first and second modes in order to make a determination as to the presence of an article in said zone.

* * * * *

UNITED STATES PATENT AND TRADEMARK OFFICE

CERTIFICATE OF CORRECTION

PATENT NO. : 5,049,857

DATED : September 17, 1991

INVENTOR(S) : Christopher B. Plonsky, Harry E. Watkins
Marco A. Paez

It is certified that error appears in the above-identified patent and that said Letters Patent is hereby corrected as shown below:

Col. 6, line 30. After "Also," insert --since the transmitter coil 21a and receiver coil 24a and the --

Col. 6, line 47. Change "quadrant" to -- quadrature --

Col. 6, line 48. Change "quadrant" to -- quadrature --

Col. 6, line 68. Change "stat" to -- state --

Col. 8, line 26. After "initialized" insert -- , --

Col. 8, line 55. Delete "and" second occurrence

Col. 11, line 30. Change "imperical" to -- empirical --

Col. 11, line 60. After "of" insert -- its --

Col. 12, line 22. Delete "the" second occurrence

Col. 16, line 43. Change "11" to -- 4 --

Col. 21, line 1. Change "56" to -- 57 --

Col. 21, line 12. Change "a" to -- an --

UNITED STATES PATENT AND TRADEMARK OFFICE

CERTIFICATE OF CORRECTION

PATENT NO. : 5,049,857

DATED : September 17, 1991

INVENTOR(S) : Christopher B. Plonsky, Harry E. Watkins and Marco A. Paez

It is certified that error appears in the above-identified patent and that said Letters Patent is hereby corrected as shown below:

In the Drawings, FIG. 4A, change "ENCREMENT" to -- INCREMENT --.

Signed and Sealed this

Twenty-fifth Day of May, 1993

*Attest:*

Michael K. Kirk

MICHAEL K. KIRK

*Attesting Officer*

*Acting Commissioner of Patents and Trademarks*